US010879653B2

(12) United States Patent
Tasaki

(10) Patent No.: US 10,879,653 B2
(45) Date of Patent: Dec. 29, 2020

(54) CONNECTING DEVICE AND CONTROL DEVICE

(71) Applicant: SHARP KABUSHIKI KAISHA, Sakai (JP)

(72) Inventor: Koji Tasaki, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 122 days.

(21) Appl. No.: 16/385,831

(22) Filed: Apr. 16, 2019

(65) Prior Publication Data

US 2019/0334294 A1 Oct. 31, 2019

(30) Foreign Application Priority Data

Apr. 27, 2018 (JP) ..... 2018-087654

(51) Int. Cl.
*H01R 13/703* (2006.01)
*H01R 13/66* (2006.01)
*H01R 13/641* (2006.01)
*H01R 13/62* (2006.01)

(52) U.S. Cl.
CPC ..... *H01R 13/7037* (2013.01); *H01R 13/6205* (2013.01); *H01R 13/641* (2013.01); *H01R 13/6683* (2013.01)

(58) Field of Classification Search
CPC ..... H01R 13/6683; H01R 13/6658; H01R 13/7037; H01R 13/641; H01R 13/6205
See application file for complete search history.

(56) References Cited

U.S. PATENT DOCUMENTS 4,434,324 A * 2/1984 Boggio ..... H04L 25/027 178/16
5,596,253 A * 1/1997 Mizuta ..... B60J 7/0573 318/469
2014/0001342 A1* 1/2014 Ke ..... G01R 31/68 250/208.2
2016/0072341 A1* 3/2016 Tamura ..... B60L 58/19 307/66
2017/0112454 A1* 4/2017 Yun ..... A61B 6/0407

FOREIGN PATENT DOCUMENTS

CN 202050089 U 11/2011
CN 206401649 U 8/2017
JP 2009-117249 A 5/2009

* cited by examiner

*Primary Examiner* — Carlos Amaya
*Assistant Examiner* — Esayas G Yeshaw
(74) *Attorney, Agent, or Firm* — ScienBiziP, P.C.

(57) ABSTRACT

To detect abnormality of a connecting section and appropriately disconnect the connecting section, the present invention refers to the result of detection by a state detection section configured to detect the state of each of a plurality of terminals to detect the presence or absence of abnormality of each of the plurality of terminals, In a case where abnormality has been detected, the present invention switches the direction of electric current flowing through an electromagnet. This disconnects a first connecting section and a second connecting section from each other.

10 Claims, 6 Drawing Sheets

CONNECTING DEVICE AND CONTROL DEVICE

This Nonprovisional application claims priority under U.S.C. § 119 on Patent Application No. 2018-087654 filed in Japan on Apr. 27, 2018, the entire contents of which are hereby incorporated by reference.

TECHNICAL FIELD

The present invention relates to (i) a connecting device used for connecting a power source to an apparatus main body and (ii) a control device for controlling the connecting device.

BACKGROUND ART

A connecting device has been known that uses an electromagnet to (i) connect a DC plug to a DC jack of an apparatus main body or) disconnect a DC plug from a DC jack. For example, the connecting device described in Patent Literature 1 uses an electromagnet to disconnect a DC plug from a DC jack in a case where the DC plug is pulled, the apparatus main body is tilted, the apparatus main body is dropped, or the apparatus main body is subjected to abnormal vibration. This prevents breakage of the DC plug and DC jack.

CITATION LIST

Patent Literature

[Patent Literature 1]
Japanese Patent Application. Publication Tokukai No. 2009-117249 (Publication date: May 28, 2009)

SUMMARY OF INVENTION

Technical Problem

The connecting device of conventional art, as described above, cannot detect abnormality that does not involve a physical movement of the apparatus main body or the connecting device. There is a need for a connecting device that can prevent damage to an apparatus main body by appropriately disconnecting a connecting section even with abnormality of a DC plug and DC jack without physical movement.

An aspect of the present invention has been accomplished in view of the above-mentioned circumstances. It is an object of the above aspect to provide a connecting device capable of detecting abnormality of a connecting section to appropriately disconnect the connecting section.

Solution to Problem

In order to attain the above-mentioned object, a connecting device according to an aspect of the present invention includes: a first connecting section; a second connecting section; and at least one control section, the first connecting section including: an electromagnet having a polarity switchable in accordance with a direction of electric current through the electromagnet; a plurality of terminals; and a state detecting section configured to detect a state of each of the plurality of terminals, the second connecting section including: a magnetic body, the magnetic body and the electromagnet attracting each other or repelling each other in accordance with the direction of the electric current, the at least one control section being configured to carry out an abnormality detecting process and an electric current switching process, the abnormality detecting process being a process of referring to a result of the detection by the state detecting section so as to detect presence or absence of abnormality of said each of the plurality of terminals, the electric current switching process being a process of switching the direction of the electric current in a case where the at least one control section has detected the abnormality.

In order to attain the above-mentioned object, a control device according to the an aspect of the present invention for controlling a connecting device includes: a first connecting section; and a second connecting section; the first connecting section including: an electromagnet having a polarity switchable in accordance with a direction of electric current through the electromagnet; a plurality of terminals; and a state detecting section configured to detect a state of each of the plurality of terminals, the second connecting section including: a magnetic body, the magnetic body and the electromagnet attracting each other or repelling each other in accordance with the direction of the electric current; an abnormality detecting section configured to refer to a result of the detection by the state detecting section so as to detect presence or absence of abnormality of said each of the plurality of terminals; and an electric current switching section configured to switch the direction of the electric current in a case where the abnormality detecting section has detected the abnormality.

Advantageous Effects of Invention

An aspect of the present invention is capable of detecting abnormality of a connecting section to disconnect the connecting section as appropriate.

DESCRIPTION OF EMBODIMENTS

Embodiment 1

Figure 1:
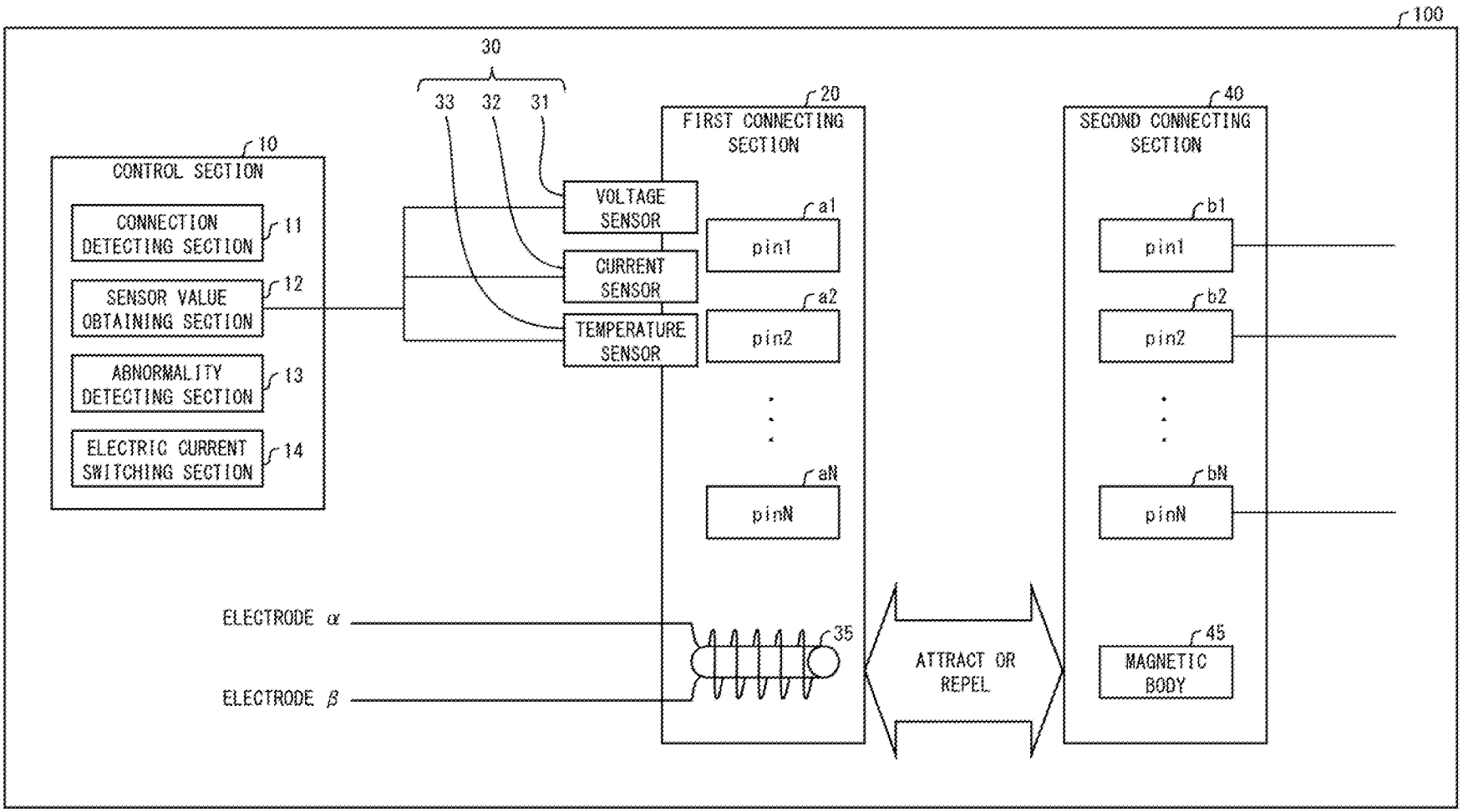
FIG. 1 is a block diagram schematically illustrating a configuration of a connecting device according to Embodiment 1.

The following description explains Embodiment 1 of the present invention in detail. FIG. 1 is a diagram schematically illustrating the configuration of a connecting device 100 according to Embodiment. The connecting device 100 is a device for connecting a power source and an apparatus main body to each other. The connecting device 100 may be provided in, for example, the apparatus main body.

As shown in FIG. 1, the connecting device 100 includes a first connecting section 20, a second connecting section 40, and at least one control section 10.

The first connecting section 20 is a power jack. The first connecting section 20 includes a plurality of terminals a1 to aN (pin 1 to pinN). The first connecting section 20 includes a state detecting section 30 for detecting the state of each of the plurality of terminals. The first connecting section 20 includes an electromagnet 35 having a polarity that is switched according to the direction of electric current.

The state detecting section 30 includes at least one of a voltage sensor 31, a current sensor 32, and a temperature sensor 33. The state detecting section 30 outputs a sensor value indicative of the state of each of the terminals a1 to aN on the basis of at least one of the voltage, the electric current, and the temperature of each of the terminals a1 to aN.

In the electromagnet 35, electric current flows from an electrode α to an electrode β or from the electrode β to the electrode α. The direction of this electric current is controlled by the control section 10. The electromagnet 35 has a magnetic property that can be switched according to the direction of the electric current.

The second connecting section 40 is a power plug, and is a power source for supplying power to the connecting device 100. The power source for supplying power to the connecting device 100 may be a commercial AC power source or a DC power source obtained by AC/DC conversion of a commercial AC power source. That is, the present invention is applicable to both AC power source and DC power source. In the following description, the power source is referred to as an AC power source or a DC power source.

The second connecting section 40 includes a plurality of terminals b1 to bN. The plurality of terminals b1 to bN correspond to the plurality of terminals a1 to aN of the first connecting section 20, respectively. The first connecting section 20 and the second connecting section 40 are configured such that the terminals a1 to aN of the first connecting section 20 and the terminals b1 to bN of the second connecting section 40 are electrically connected to each other. This connection makes it possible to supply power from an AC power source or a DC power source to the apparatus main body.

The second connecting section 40 includes a magnetic body 45. The magnetic body 45 is provided at a position corresponding to the electromagnet 35 of the first connecting section 20. The magnetic body 45 and the electromagnet 35 either attract each other or repel each other, according to the direction of the electric current flowing through the electromagnet 35

Configuration of the Control Section 10

The control section 10 is an arithmetic unit having the function of centrally controlling each section of the connecting device 100. The control section 10 controls each component of the connecting device 100 as one or more processors (e.g., CPUs), for example, execute programs stored in one or more memories (e.g., RAMs and ROMs).

The control section 10 includes a connection detecting section 11, a sensor value obtaining section 12, an abnormality detecting section 13, and an electric current switching section 14.

The connection detecting section 11 refers to the voltage value or the electric current value of the first connecting section 20 to detect whether the first connecting section 20 and the second connecting section 40 are connected to each other or the first connecting section 20 and the second connecting section 40 are disconnected from each other. The connection detecting section 11 may detect the connection state of the connecting device 100 by referring to, for example, a sensor value indicative of the state of each of the plurality of terminals a1 to ail which sensor value has been obtained by the sensor value obtaining section 12 from the state detecting section 30.

The sensor value obtaining section 12 obtains a sensor value of at least one of the voltage sensor 31, the current sensor 32, and the temperature sensor 33 included in the state detecting section 30 of the first connecting section 20. In a case where the state detecting section 30 includes a plurality of sensors, the sensor value obtaining section 12 may selectively acquire each sensor value, sequentially acquire each sensor value, or collectively acquire each sensor value at predetermined intervals.

The abnormality detecting section 13 refers to the result of detection by the state detecting section 30 which result has been obtained by the sensor value obtaining section 12, and thereby detects the presence or absence of abnormality of each of the plurality of terminals a1 to aN. The abnormality detecting section 13 detects abnormality in at least one of the voltage, the electric current, and the temperature of each of the plurality of terminals a1 to aN by referring to the sensor value of at least one of the voltage sensor 31, the current sensor 32, and the temperature sensor 33.

The abnormality detecting section 13 may be capable of detecting a contact failure of each of the plurality of terminals a1 to aN by referring to the sensor value of the voltage sensor 31 which sensor value has been obtained by the sensor value obtaining section 12. The abnormality detecting section 13 compares the sensor value of the voltage sensor 31 with a predetermined appropriate value stored in advance. In a case where the sensor value of the voltage sensor 31 shows a voltage drop with respect to the appropriate voltage, the abnormality detecting section 13 determines that a contact failure has occurred at one or more of the plurality of terminals a1 to aN.

The abnormality detecting section 13 refers to the respective sensor values of the voltage sensor 31 and the current sensor 32 to calculate the resistive component. The abnormality detecting section 13 may compare the calculated resistance with an appropriate value to detect whether the contact resistance of each of the plurality of terminals a1 to aN has been increased.

The abnormality detecting section 13 may be capable of detecting an insulation failure of each of the plurality of terminals a1 to aN by referring to the sensor value of the current sensor 32 which sensor value has been obtained by the sensor value obtaining section 12. In a case where the sensor value of the current sensor 32 indicates an increase in the leak electric current, the abnormality detecting section 13 determines that an insulation failure has occurred at one or more of the plurality of terminals a1 to aN.

The abnormality detecting section 13 may be capable of detecting a heat generation abnormality of each of the plurality of terminals a1 to aN by referring to the sensor value of the temperature sensor 33 which sensor value has been obtained by the sensor value obtaining section 12. The abnormality detecting section 13 refers to the sensor value of the temperature sensor 33. This allows the abnormality detecting section 13 to detect heat generation in a case where a temperature rise has occurred at each of the plurality of terminals a1 to aN.

In a case where the abnormality detecting section 13 has detected abnormality, the electric current switching section 14 switches the direction of the electric current flowing through the electromagnet 35. The electric current switching section 14 causes electric current to, in a normal state, that is, when no abnormality is detected by the abnormality detecting section 13, flow through the electromagnet 35 in such a direction that the electromagnet 35 and the magnetic body 45 attract each other. In a case where the abnormality detecting section 13 has detected one or more abnormalities, the electric current switching section 14 switches the direction of the electric current flowing through the electromagnet 35 so that the electromagnet 35 and the magnetic body 45 repel each other.

Control by Control Section 10

The first connecting section 20 and the second connecting section 40 supply power from the power source to the apparatus main body. Therefore, for example, abnormalities may occur such as (i) a contact failure due to temporal degradation of the terminals a1 to aN and the terminals b1 to bN and an insulation failure due to water leakage or wetting caused by salt water. A contact failure also occurs in a case where the lines of the first connecting section 20 that are not grounded have resistances. An insulation failure also occurs in a case where the grounded lines of the first connecting section 20 have resistances.

In a case where electric current flows through lines having resistances as described above, an heat generation abnormality occurs at one or more of the terminals a1 to aN (the square of electric current is the Joule heat of the heat generation, as indicated by $P=I^2\times R$).

Figure 2:
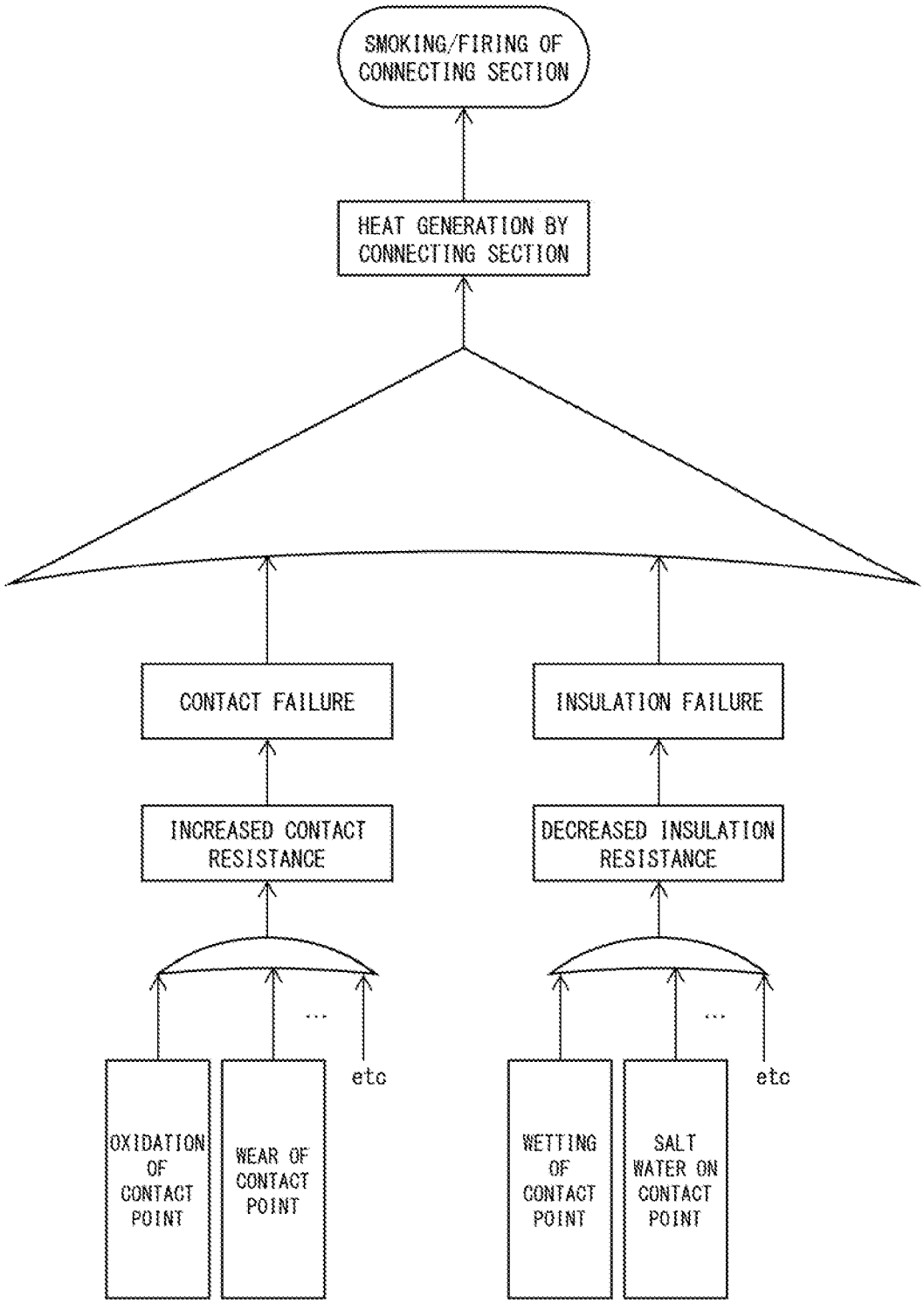
FIG. 2 is a diagram illustrating an analytical tree for analyzing abnormality that leads to heat generation and smoking of a first connecting section.

FIG. 2 is a diagram illustrating an analytic tree for analyzing abnormality leading to heat generation and smoking of the first connecting section 20. As shown in 2, in a case where the downstream-most event is smoking or firing of a connecting section, the cause is heating of the first connecting section 20. Examples of causes of heat generation by the first connecting section 20 include a contact failure and an insulation failure. A contact failure is caused by increased contact resistance. An insulation failure is caused by decreased insulation resistance.

There are various causes of increased contact resistance such as oxidization of a contact point and wear of a contact point. There are various causes of decreased insulation resistance such as water leakage at a contact point and wetting of a contact point with salt water. The abnormality detecting section 13 analyzes the correlation between the cause and the result of an abnormality at each of the terminals a1 to aN of the first connecting section 20 with use of the analysis tree shown in FIG. 2.

Assuming that the appropriate value of the voltage of each of the terminals a1 to aN is, for example, 4.75 V to 5.25 V, the abnormality detecting section 13 determines that the voltage is abnormal, in a case where the sensor value of the voltage sensor 31 which sensor value has been obtained by the sensor value obtaining section 12 is higher than the appropriate value and in a case where the sensor value is lower than the appropriate value.

Assuming that the appropriate value of the electric current of each of the terminals a1 to aN is, for example, 1 A to 3 A, the abnormality detecting section 13 determines that the electric current is abnormal, in a case where the sensor value of the current sensor 32 which sensor value has been obtained by the sensor value obtaining section 12 is larger than the appropriate value and in a case where the sensor value is smaller than the appropriate value.

Assuming that the appropriate value of the temperature of each of the terminals a1 to aN is, for example, −10° C. to 60° C., the abnormality detecting section 13 determines that the temperature is abnormal, in a case where the sensor value of the temperature sensor 33 which sensor value has been obtained by the sensor value obtaining section 12 is higher than the appropriate value and in a case where the sensor value is lower than the appropriate value.

In a case where the abnormality detecting section 13 refers to the sensor value of the voltage sensor 31 and the sensor value of the temperature sensor 33, and at least one of the voltage and the temperature is abnormal, the abnormality detecting section 13 determines that the contact resistance has been increased. In a case where the abnormality detecting section 13 has determined as such that the contact resistance has been increased, the first connecting section 20 may generate heat. Thus, in a case where the abnormality detecting section 13 has detected an increase in the contact resistance, the electric current switching section 14 switches the direction of the electric current flowing through the electromagnet 35 so that the electromagnet 35 and the magnetic body 45 repel each other. This breaks the connection between the first connecting section 20 and the second connecting section 40.

In a case where the abnormality detecting section 13 refers to the sensor value of the current sensor 32 and the sensor value of the temperature sensor 33, and at least one of the electric current and the temperature is abnormal, the abnormality detecting section 13 determines that the insulation resistance has been decreased. In a case where the abnormality detecting section 13 has determined as such that the insulation resistance has been decreased, the first connecting section 20 may generate heat. Thus, in a case where the abnormality detecting section 13 has detected a decrease in the insulation resistance, the electric current switching section 14 switches the direction of the electric current flowing through the electromagnet 35 so that the electromagnet 35 and the magnetic body 45 repel each other. This breaks the connection between the first connecting section 20 and the second connecting section 40.

In a case where the abnormality detecting section 13 refers to the sensor value of the voltage sensor 31, the sensor value of the current sensor 32, and the sensor value of the temperature sensor 33, and at least one of the voltage, the electric current, and the temperature is abnormal, the abnormality detecting section 13 determines that the contact resistance has been increased or that the insulation resistance has been decreased. In a case where the abnormality detecting section 13 has detected as such an increase in the contact resistance or a decrease in the insulation resistance, the first connecting section 20 may generate heat. Thus, in a case where the abnormality detecting section 13 has detected an increase in the contact resistance or a decrease in the insulation resistance, the electric current switching section 14 switches the direction of the electric current flowing through the electromagnet 35 so that the electromagnet 35 and the magnetic body 45 repel each other. This breaks the connection between the first connecting section 20 and the second connecting section 40.

Figure 3:
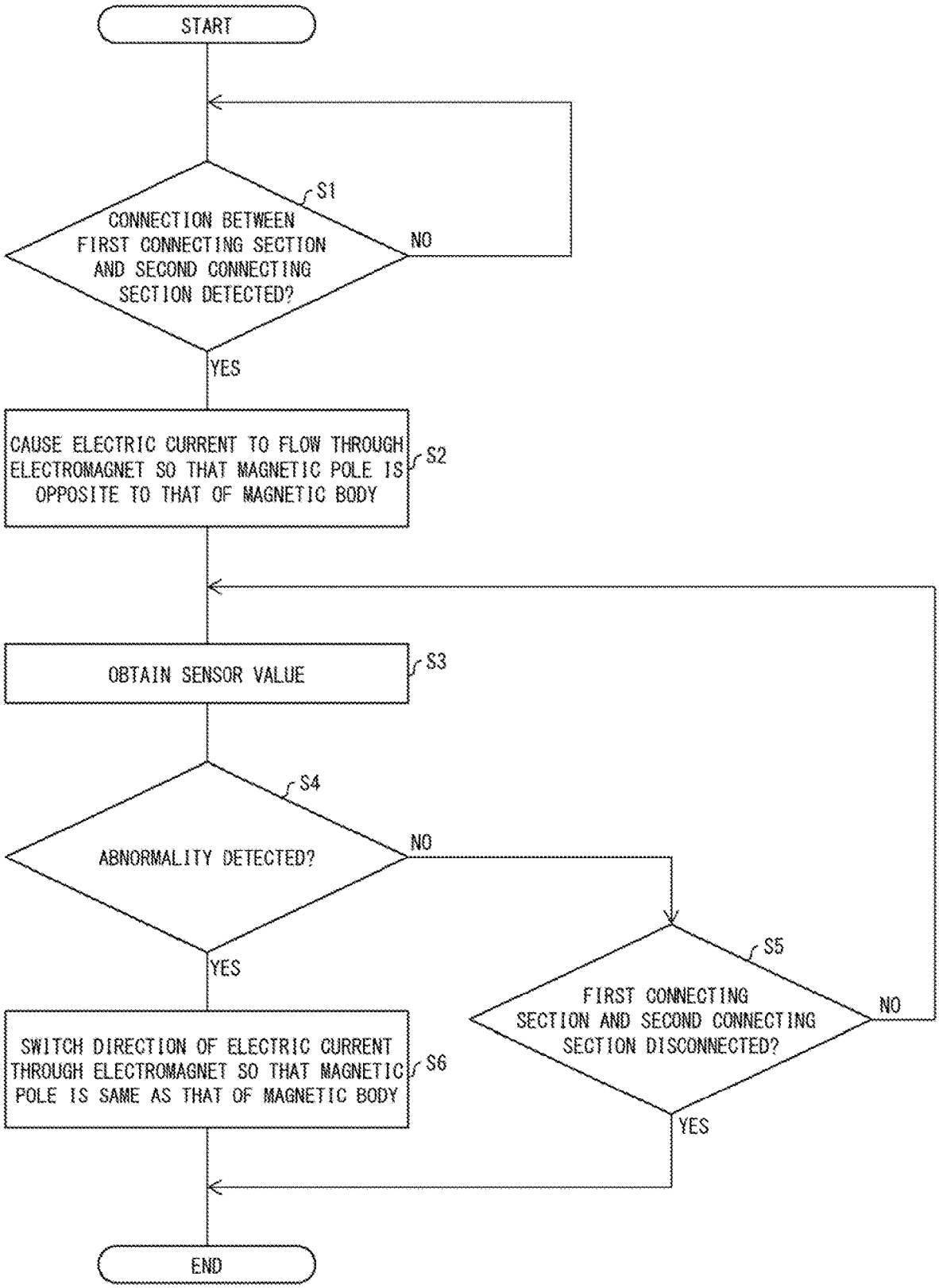
FIG. 3 is a flow chart illustrating the flow of a process carried out by a control section according to Embodiment 1.

Flow of process by control section 10 FIG. 3 is a flow chart showing the flow of a process carried out by the control section 10. The following description explains the individual steps of the process with reference to FIG. 3.

Step S1

The control section 10 uses the function of the connection detecting section 11 to determine whether a connection between the first connecting section 20 and the second connecting section 40 has been detected. The control section 10 repeats step S1 until the control section detects a connection between the first connecting section 20 and the second connecting section 40 (while Step S1 is NO). If the control section 10 has detected that the first connecting section 20 and the second connecting section 40 are connected to each other (YES in step S1), the process proceeds to step S2.

Step S2

The control section 10 uses the function of the electric current switching section 14 to cause electric current to flow through the electromagnet 35 in such a direction that the electromagnet 35 and the magnetic body 45 attract each other.

Step S3

The control section 10 uses the function of the sensor value obtaining section 12 to obtain a sensor value of at least one of the sensors 31, 32, and 33 of the state detecting section 30.

Step S4

The control section 10 detects the presence or absence of abnormality of each of the plurality of terminals a1 to aN by referring to the sensor value obtained with use the function of the abnormality detecting section 13. If the control section 10 did not detect abnormality of the terminals a1 to aN (NC) in step S4), the process proceeds to step S5. If the control section 10 has detected abnormality of one or more of the terminals a1 to aN (YES in step S4), the process proceeds to step S6.

Step S5

The control section 10 uses the function of the connection detecting section 11 to determine whether the first connecting section 20 and the second connecting section 40 have been disconnected from each other. If the control section 10 has determined that the first connecting section 20 and the second connecting section 40 have been disconnected from each other (YES in step S5), the process ends there. If the control section 10 has determined that the first connecting section 20 and the second connecting section 40 are not disconnected from each other (NO in step S5), the process returns to step S3 and continues.

Step S6

The control section 10 uses the function of the electric current switching section 14 to switch the direction of the electric current flowing through the electromagnet 35 so that the electromagnet 35 and the magnetic body 45 repel each other. This disconnects the first connecting section 20 and the second connecting section 40 from each other. The process ends there.

As described above, in a case where abnormality has been caused in at least one of the voltage, the electric current, and the temperature at any of the plurality of terminals a1 to aN of the first connecting section 20, the control section 10 switches the direction of the electric current flowing through the electromagnet 35. This disconnects the first connecting section 20 and the second connecting section 40 from each other. Therefore, the connecting device 100 can detect abnormality of the first connecting section 20 or the second connecting section 40, and as a result, can appropriately disconnect the first connecting section 20 and the second connecting section 40 from each other.

Embodiment 2

The following description explains Embodiment 2 of the present invention. For convenience of explanation, any member of the present embodiment that has the same function as a member described for the above embodiment is assigned the same reference sign, and a description of such members will not be repeated there.

Figure 4:
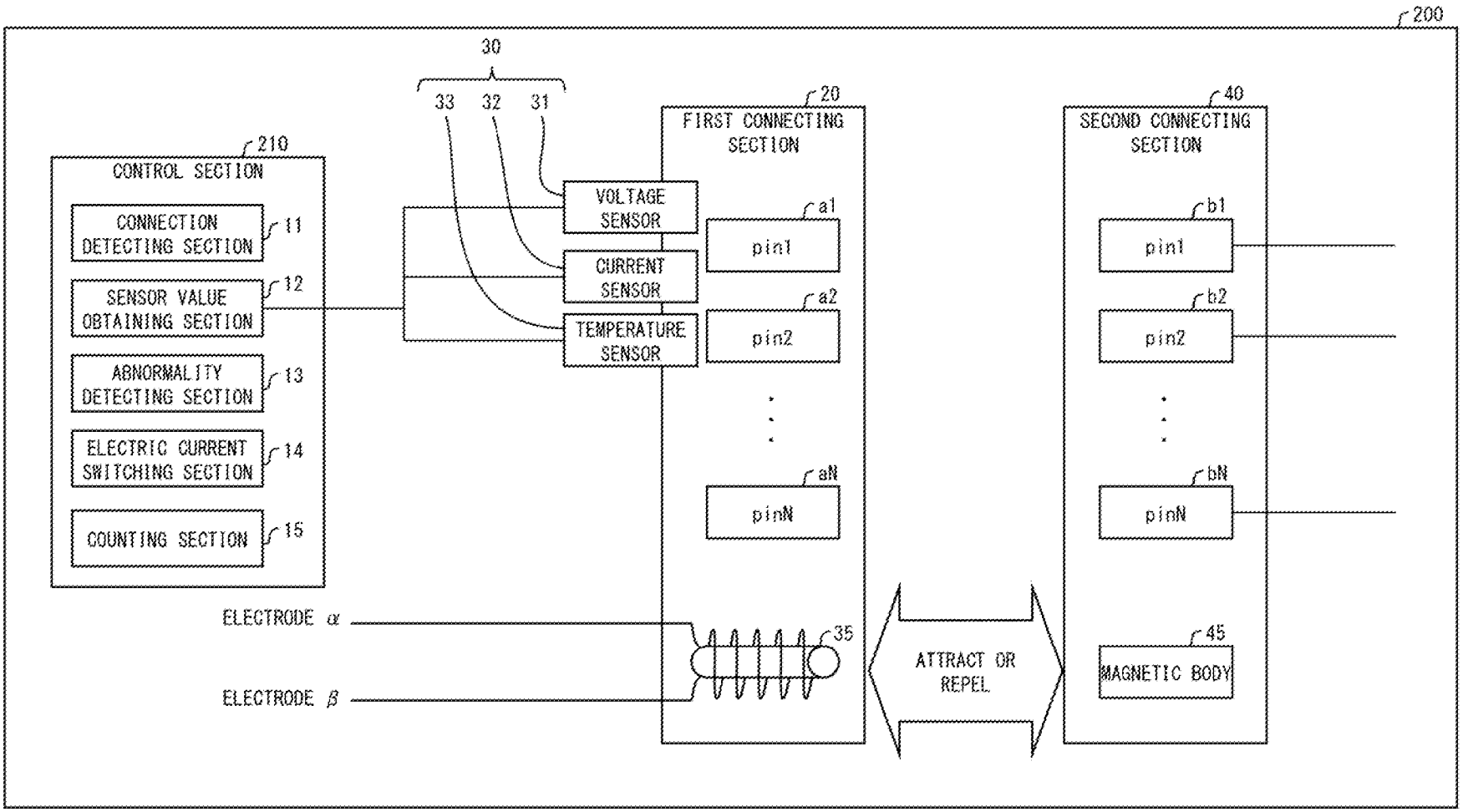
FIG. 4 is a block diagram schematically illustrating a configuration of a connecting device according to Embodiment 2.

FIG. 4 is a diagram schematically showing the configuration of a connecting device 200 according to Embodiment 2. The connecting device 200 has a configuration similar to that of the connecting device 100 of Embodiment 1 except only that a control section 210 further includes a counting section 15 in addition to the members of the control section 10 described for Embodiment 1.

The counting section 15 of the control section 210 has the function of counting the number of times the abnormality detecting section 13 has detected abnormality. In a case where, for instance, the abnormality detecting section 13 has detected abnormality only once, the abnormality detecting section 13 may have detected the abnormality as a result of a malfunction of at least one of the sensors 31, 32, and 33 of the state detecting section 30. In view of that, the connecting device 200 according to Embodiment 2 has a mechanism for counting the number of times the abnormality detecting section 13 has detected abnormality. This allows abnormality of the first connecting section 20 or the second connecting section 40 to be reliably determined.

Flow of Process by Control Section 210

Figure 5:
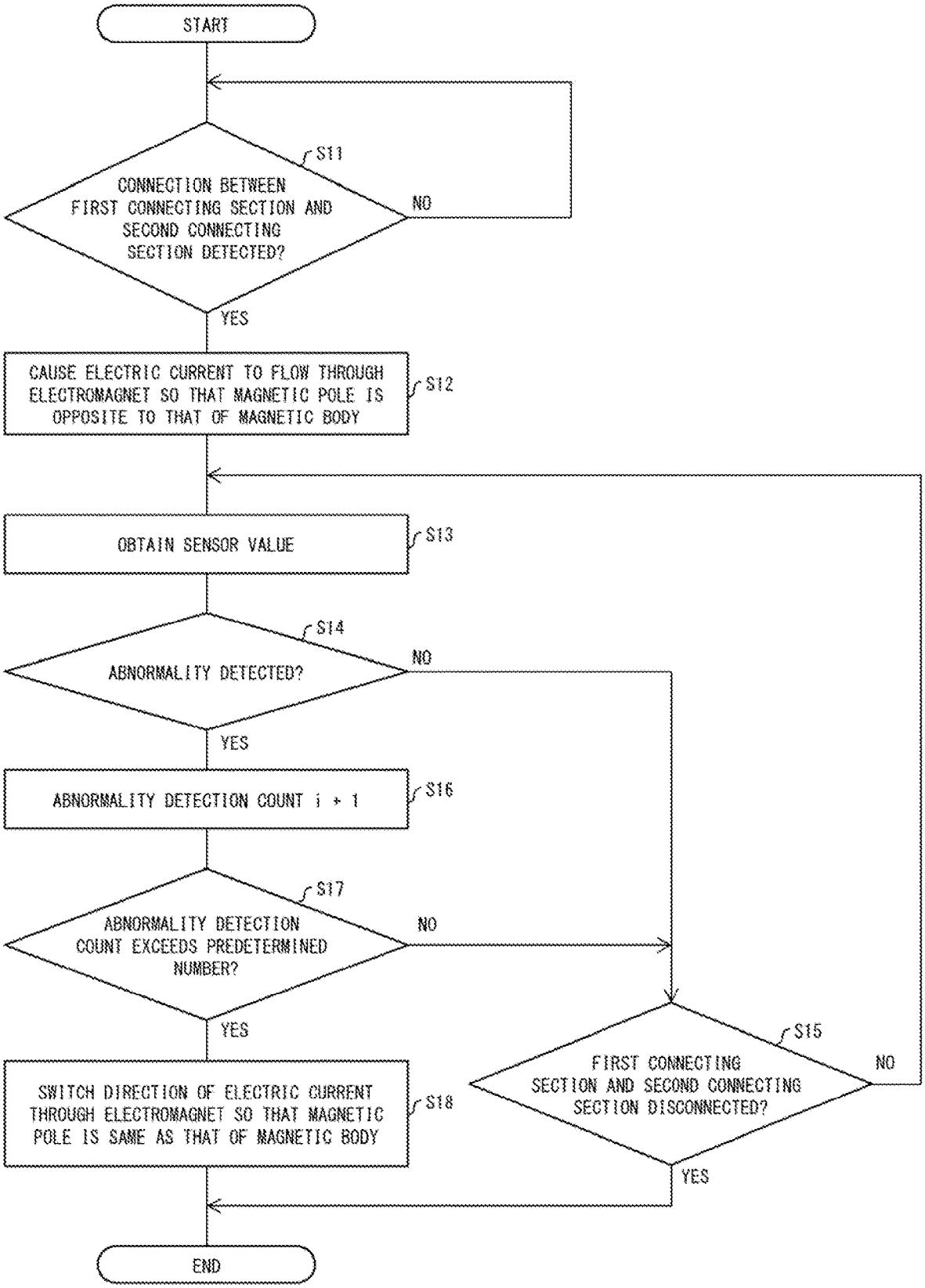
FIG. 5 a flow chart illustrating the flow of a process carried out by a control section according to Embodiment 2.

FIG. 5 is a flow chart showing the flow of a process carried out by the control section 210. The following description explains the individual steps of the process with reference to FIG. 5.

Step S11

The control section 210 uses the function of the connection detecting section 11 to determine whether a connection between the first connecting section 20 and the second connecting section 40 has been detected. The control section 210 repeats step S11 until the control section 210 detects a connection between the first connecting section and the second connecting section 40 (while step S11 is NO). If the control section 210 has detected that the first connecting section 20 and the second connecting section 40 are connected to each other (YES in step S11), the process proceeds to step S12.

Step S12

The control section 210 uses the function of the electric current switching section 14 to cause electric current to flow through the electromagnet 35 in such a direction that the electromagnet 35 and the magnetic body 45 attract each other.

Step S13

The control section 210 uses the function of the sensor value obtaining section 12 to obtain a sensor value of at least one of the sensors 31, 32, and 33 of the state detecting section 30.

Step S14

The control section 210 detects the presence or absence of abnormality of each of the plurality of terminals a1 to aN by referring to the sensor value obtained with use of the function of the abnormality detecting section 13. If the control section 210 did not detect abnormality of the terminals a1 to aN (NO in step S14), the process proceeds to step S15. If the control section 210 has detected abnormality of one or more of the terminals a1 to aN (YES in step S14), the process proceeds to step S16.

Step S15

The control section 210 uses the function of the connection detecting section 11 to determine whether the first connecting section 20 and the second connecting section 40 have been disconnected from each other. If the control section 210 has determined that the first connecting section 20 and the second connecting section 40 have been disconnected from each other (YES in step S15), the process ends there. If the control section 210 has determined that the first connecting section 20 and the second connecting section 40 are not disconnected from each other (NO in step S15), the process returns to step S13 and continues.

Step S16

The control section 210 uses the function of the counting section 15 to increment the count of the number of times the control section 210 has detected abnormality by one (i+1). The control section 210 may initialize, at a predetermined time point, the count of the number of times the control section 210 has detected abnormality (may be set to 0). Examples of the predetermined time point include the following: (i) In a case where a new connection between the first connecting section 20 and the second connecting section 40 has been detected. In a case where disconnection between the first connecting section 20 and the second connecting section 40 has been detected. In a case where new abnormality has not been detected for a predetermined period or longer while the first connecting section 20 and the second connecting section 40 are connected to each other.

Step S17

The control section 210 determines whether the number of times the abnormality has been detected with use the function of the counting section 15 exceeds a predetermined number. If the control section 210 has determined that the number of times the control section 210 has detected abnormality does not exceed the predetermined number (NO in step S17), the process returns to step S15. If the control section 210 has determined that the number of times the control section 210 has detected abnormality does exceed the predetermined number (YES in step S17), the process proceeds to step S18.

Step S18

The control section 210 uses the function of the electric current switching section 14 to switch the direction of the electric current flowing through the electromagnet 35 so that the electromagnet 35 and the magnetic body 45 repel each other. This disconnects the first connecting section 20 and the second connecting section 40 from each other. The process ends there.

As described above, in a case where (i) abnormality has been caused in at least one of the voltage, the electric current, and the temperature at any of the plurality of terminals a1 to aN of the first connecting section 210 and the number of times the control section 210 has detected abnormality exceeds a predetermined number, the control section 210 switches the direction of the electric current flowing through the electromagnet 35. This disconnects the first connecting section 20 and the second connecting section 40 from each other. Therefore, the connecting device 100 can reliably detect abnormality of the first connecting section 20 or the second connecting section 40, and as a result, can appropriately disconnect the first connecting section 20 and the second connecting section 40 from each other.

Embodiment 3

The following description explains Embodiment 3 of the present invention. For convenience of explanation, any member of the present embodiment that has the same function as a member described for the above embodiments is assigned the same reference sign, and a description of such members will not be repeated here. The configuration of the connecting device according to Embodiment 3 is similar to that of the connecting device 200 of Embodiment 2 described above, and a description of the configuration of the connecting device according to Embodiment 3 is omitted here.

The control section 210 of Embodiment 3 detects abnormality of the first connecting section 20 or the second connecting section 40, and thus switches the direction of electric current flowing through the electromagnet 35 so that the electromagnet 35 and the magnetic body 45 repel each other. Thereafter, the control section 210 of Embodiment 3 further performs a process of determining whether the first connecting section 20 and the second connecting section 40 have been disconnected from each other.

Flow of Process by Control Section 210

Figure 6:
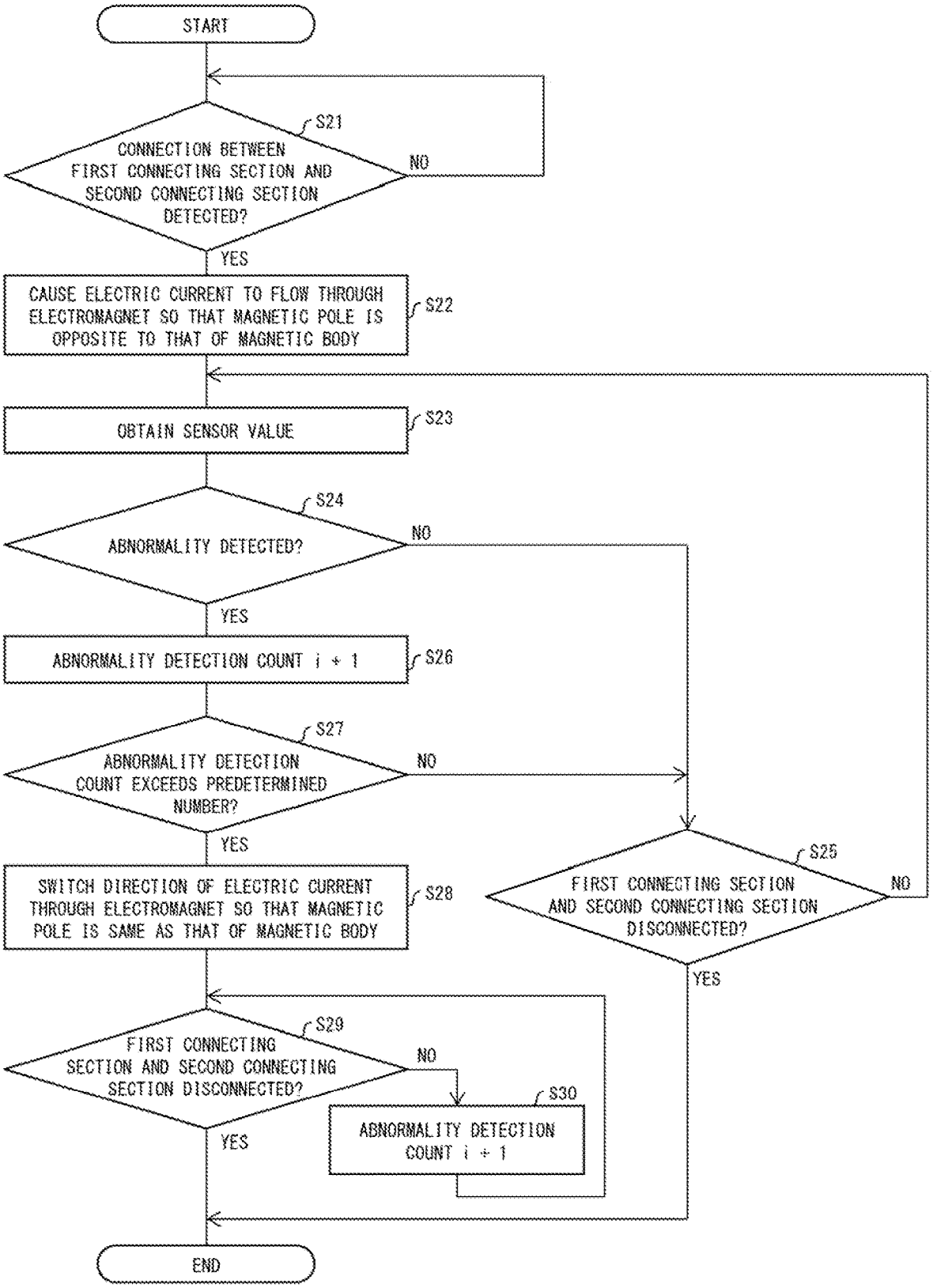
FIG. 6 is a flow chart illustrating the flow of a process carried out by a control section according to Embodiment 3.

FIG. 6 is a flow chart showing the flow of a process carried out by the control section 210. The following description explains the individual steps of the process with reference to FIG. 6. Steps S21 to S28 are similar to steps S11 to S18 carried out by the control section 210 according to Embodiment 2 which steps are described with reference to FIG. 5. A description of steps S21 to S28 is omitted here.

Step S29

In step S28, the control section 210 switches the direction of electric current flowing through the electromagnet 35. Thereafter, the control section 210 uses the function of the connection detecting section 11 to determine whether the first connecting section 20 and the second connecting section 40 have been disconnected from each other. If the control section 210 has determined that the first connecting section 20 and the second connecting section 40 are not disconnected from each other (NO in step S29), the process proceeds to step S30. If the control section 210 has determined that the first connecting section 20 and the second connecting section 40 have been disconnected from each other (YES in S29), the process ends there.

Step S30

The control section 210 uses the function of the electric current switching section 14 to increase the electric current flowing through the electromagnet 35 so that the electromagnet 35 and the magnetic body 45 repel each other. The process returns to step S29.

As described above, in a case where (i) abnormality has been caused in at least one of the voltage, the electric current, and the temperature at any of the plurality of terminals a1 to aN of the first connecting section 20, and the first connecting section 20 and the second connecting section 40 are not disconnected from each other after the direction of the electric current flowing through the electromagnet 35 was switched, the control section 210 increases the electric current flowing through the electromagnet 35. Thus, in a case where the control section 210 has detected abnormality of the first connecting section 20 or the second connecting section 40, the control section 210 can reliably disconnect the first connecting section 20 and the second connecting section 40 from each other.

Software Implementation Example

Control blocks of the control device 10, 210 (particularly, the detecting section 11, the sensor value obtaining section 12, the abnormality detecting section 13, the electric current switching section 14, and the counting section 15) can be realized by a logic circuit (hardware) provided in an integrated circuit (IC chip) or the like or can be alternatively realized by software.

In the latter case, the control device 10, 210 includes a computer that executes instructions of a program that is software realizing the foregoing functions. The computer includes, for example, at least one processor (control device), and also includes at least one computer-readable storage medium storing the programs. An object of the present invention can be achieved by the processor of the computer reading and executing the program stored in the storage medium. The processor is, for example, a central processing unit (CPU). Examples of the storage medium encompass "a non-transitory tangible medium" such as a read-only memory (ROM), a tape, a disk, a card, a semiconductor memory, and a programmable logic circuit. The computer may further include a random-access memory (RAM) in which the program is loaded. The program can be supplied to or made available to the computer via any transmission medium (such as a communication network or a broadcast wave) which allows the program to be transmitted. Note that an aspect of the present invention can also be achieved in the form of a computer data signal in which the program is embodied via electronic transmission and which is embedded in a carrier wave.

[Recap]

A connection device (100) according to a first aspect of the present invention includes: a first connecting section (20); a second connecting section (40); and at least one control section (10), the first connecting section (20) including: an electromagnet (35) having a polarity switchable in accordance with a direction of electric current through the electromagnet; a plurality of terminals (a1 to aN); and a state detecting section (30) configured to detect a state of each of the plurality of terminals (a1 to aN), the second connecting section (40) including: a magnetic body (45), the magnetic body (45) and the electromagnet (35) attracting each other or repelling each other in accordance with the direction of the electric current, the at least one control section (10) being configured to carry out an abnormality detecting process and an electric current switching process, the abnormality detecting process being a process of referring to a result of the detection by the state detecting section (30) so as to detect presence or absence of abnormality of said each of the plurality of terminals (a1 to aN), the electric current switching process being a process of switching the direction of the electric current in a case where the at least one control section has detected the abnormality.

The above-described configuration makes it possible to detect abnormality of each of the plurality of terminals (a1 to aN) to allow the first connecting section (20) and the second connecting section (40) to be disconnected from each other appropriately.

A connecting device (100) according to a second aspect of the present invention is configured as in the first aspect and may be further configured such that the at least one control section is configured to detect abnormality in at least one of a voltage, electric current, and temperature of said each of the plurality of terminals (a1 to aN).

The above-described configuration makes it possible to detect abnormality of at least one of the voltage, the electric current, and the temperature of the plurality of terminals (a1 to aN) to allow the first connecting section (20) and the second connecting section (40) to be disconnected from each other appropriately.

A connecting device (100) according to a third aspect of the present invention is configured as in the first or second aspect and may be further configured such that the state detecting section (30) includes: a voltage sensor configure to detect the voltage of said each of the plurality of terminals (a1 to aN); and a current sensor configure to detect the electric current of said each of the plurality of terminals (a1 to aN), and the at least one control section (10) is configured to refer to a sensor value of each of the voltage sensor and the current sensor so as to detect presence or absence of increased contact resistance of said each of the plurality of terminals (a1 to aN).

The above configuration allows the first connecting section (20) and the second connecting section (40) to be disconnected from each other in a case where the control section has detected an increased contact resistance of the terminals (a1 to aN).

A connecting device (100) according to a fourth aspect of the present invention is configured as in the third aspect and may be further configured such that the at least one control section (10) is configured to refer to a sensor value of the voltage sensor so as to detect a contact failure of said each of the plurality of terminals (a1 to aN).

The above configuration allows the first connecting section (20) and the second connecting section (40) to be disconnected from each other in a case where the control section has detected a contact failure of the terminals (a1 to aN).

A connecting device (100) according to a fifth aspect of the present invention is configured as in the third aspect and may be further configured such that the at least one control section (10) is configured to refer to a sensor value of the current sensor so as to detect an insulation failure of said each of the plurality of terminals (a1 to aN).

The above configuration allows the first connecting section (20) and the second connecting section (40) to be disconnected from each other in a case where the control section has detected an insulation failure of the terminals (a1 to aN).

A connecting device (100) according to a sixth aspect of the present invention is configured as in any of the third to fifth aspects and may be further configured such that the state detecting section (30) further includes a temperature sensor configured to detect the temperature of said each of the plurality of terminals (a1 to aN), and the at least one control section (10) is configured to refer to a sensor value of the temperature sensor so as to detect a heating abnormality of said each of the plurality of terminals (a1 to aN).

The above-described configuration allows the first connecting section (20) and the second connecting section (40) to be disconnected from each other in a case where the control section has detected a heat generation abnormality of the terminals (a1 to aN).

A connecting device (100) according to a seventh aspect of the present invention is configured as in the first or sixth aspect and may be further configured such that while the at least one control section (10) has not detected the abnormality, the at least one control section causes the electric current to flow through the electromagnet (35) in such a direction that the electromagnet (35) and the magnetic body (45) attract each other, and in a case where the at least one control section (10) has detected at least one abnormality, the at least one control section (10) switches the direction of the electric current so that the electromagnet (35) and the magnetic body (45) repel each other.

In the above configuration, in a case where the control section has detected abnormality, the direction of the electric current flowing through the electromagnet 35 is switched. This allows the first connecting section (20) and the second connecting section (40) to be disconnected from each other.

A connecting device (100) according to an eighth aspect of the present invention is configured as in any of the first to seventh aspects and may be further configured such that the at least one control section (10) includes a counting section configured to count the number of abnormalities detected through the abnormality detecting process, and in a case where the number of abnormalities counted by the counting section has exceeded a predetermined number, the at least one control section (10) causes the electric current to flow through the electromagnet (35) so that the electromagnet (35) and the magnetic body (45) repel each other.

In the above-described configuration, in a case where the number of times of abnormality exceeds a predetermined number, the first connecting section (20) and the second connecting section (40) are disconnected from each other. This prevents the first connecting section (20) and the second connecting section (40) from being disconnected from each other by a false positive of abnormality. In addition, the above configuration allows for reliable detection of abnormality and allows the first connecting section (20) and the second connecting section (40) to be disconnected from each other.

A connecting device (100) according to a ninth aspect of the present invention is configured as in any of the first to eighth aspects and may be configured such that after the at least one control section (10) has caused the electric current to flow through the electromagnet (35) so that the electromagnet (35) and the magnetic body (45) repel each other, the at least one control section (10) determines whether the first connecting section (20) and the second connecting section (40) have been disconnected from each other, and in a case where the first connecting section (20) and the second connecting section (40) are not disconnected from each other, the at least one control section (10) increases the electric current flowing through the electromagnet (35).

The above configuration increases the electric current flowing to the electromagnet (35) in a case where the first connecting section (20) and second connecting section (40) are not disconnected from each other after the control section has detected abnormality. This allows the first connecting section (20) and the second connecting section (40) to be reliably disconnected from each other.

A control device (10) according to a tenth aspect for controlling a connection device (100) includes a first connecting section (20); and a second connecting section (40); the first connecting section (20) including: an electromagnet (35) having a polarity switchable in accordance with a direction of electric current through the electromagnet (35); a plurality of terminals (a1 to aN); and a state detecting section (30) configured to detect a state of each of the plurality of terminals (a1 to aN), the second connecting section (40) including: a magnetic body (45), the magnetic body (45) and the electromagnet (35) attracting each other or repelling each other in accordance with the direction of the electric current; an abnormality detecting section (13) configured to refer to a result of the detection by the state detecting section (30) so as to detect presence or absence of abnormality of said each of the plurality of terminals (a1 to aN); and an electric current switching section (14) configured to switch the direction of the electric current in a case where the abnormality detecting section (13) has detected the abnormality.

The control section 10, 210 according to the foregoing embodiments of the present invention may be realized by a computer. In this case, the present invention encompasses: a control program for the control device which program causes a computer to operate as each foregoing section (soft are element) of the control section 10, 210 so that control section 10, 210 can be realized by the computer; and a computer-readable storage medium storing the control program therein.

The present invention is not limited to the embodiments, but can be altered by a skilled person in the art within the scope of the claims. The present invention also encompasses, in its technical scope, any embodiment derived by combining technical means disclosed in differing embodiments. Further, it is possible to form a new technical feature by combining the technical means disclosed in the respective embodiments.

REFERENCE SIGNS LIST

10, 210 Control section
11 Connection detecting section
12 Sensor value obtaining section
13 Abnormality detecting section
14 Electric current switching section
15 Counting section
20 First connecting section
30 State detecting section
31 Voltage sensor
32 Current sensor
33 Temperature sensor
35 Electromagnet
40 Second connecting section.
45 Magnetic body
100, 200 Connecting device

The invention claimed is:

1. A connecting device, comprising:
a first connecting section;
a second connecting section; and
at least one control section,
the first connecting section including:
an electromagnet having a polarity switchable in accordance with a direction of electric current through the electromagnet;
a plurality of terminals; and
a state detecting section configured to detect a state of each of the plurality of terminals,
the second connecting section including:
a magnetic body, the magnetic body and the electromagnet attracting each other or repelling each other in accordance with the direction of the electric current,
the at least one control section being configured to carry out an abnormality detecting process and an electric current switching process,
the abnormality detecting process being a process of referring to a result of the detection by the state detecting section so as to detect presence or absence of abnormality of said each of the plurality of terminals,
the electric current switching process being a process of switching the direction of the electric current in a case where the at least one control section has detected the abnormality.

2. The connecting device according to claim 1, wherein
the at least one control section is configured to detect abnormality in at least one of a voltage, electric current, and temperature of said each of the plurality of terminals.

3. The connecting device according to claim 1, wherein
the state detecting section includes:
a voltage sensor configure to detect the voltage of said each of the plurality of terminals; and
a current sensor configure to detect the electric current of said each of the plurality of terminals, and
the at least one control section is configured to refer to a sensor value of each of the voltage sensor and the current sensor so as to detect presence or absence of increased contact resistance of said each of the plurality of terminals.

4. The connecting device according to claim 3, wherein the at least one control section is configured to refer to a sensor value of the voltage sensor so as to detect a contact failure of said each of the plurality of terminals.

5. The connecting device according to claim 3, wherein the at least one control section is configured to refer to a sensor value of the current sensor so as to detect an insulation failure of said each of the plurality of terminals.

6. The connecting device according to claim 3, wherein the state detecting section further includes a temperature sensor configured to detect the temperature of said each of the plurality of terminals, and the at least one control section is configured to refer to a sensor value of the temperature sensor so as to detect a heating abnormality of said each of the plurality of terminals.

7. The connecting device according to claim 1, wherein while the at least one control section has not detected the abnormality, the at least one control section causes the electric current to flow through the electromagnet in such a direction that the electromagnet and the magnetic body attract each other, and in a case where the at least one control section has detected at least one abnormality, the at least one control section switches the direction of the electric current so that the electromagnet and the magnetic body repel each other.

8. The connecting device according to claim 1, wherein the at least one control section includes a counting section configured to count the number of abnormalities detected through the abnormality detecting process, and in a case where the number of abnormalities counted by the counting section has exceeded a predetermined number, the at least one control section causes the electric current to flow through the electromagnet so that the electromagnet and the magnetic body repel each other.

9. The connecting device according to claim 1, wherein after the at least one control section has caused the electric current to flow through the electromagnet so that the electromagnet and the magnetic body repel each other, the at least one control section determines whether the first connecting section and the second connecting section have been disconnected from each other, and in a case where the first connecting section and the second connecting section are not disconnected from each other, the at least one control section increases the electric current flowing through the electromagnet.

10. A controlling device for controlling a connecting device, the connecting device comprising:

a first connecting section; and a second connecting section;

the first connecting section including:

an electromagnet having a polarity switchable in accordance with a direction of electric current through the electromagnet;

a plurality of terminals; and a state detecting section configured to detect a state of each of the plurality of terminals, the second connecting section including:

a magnetic body, the magnetic body and the electromagnet attracting each other or repelling each other in accordance with the direction of the electric current;

an abnormality detecting section configured to refer to a result of the detection by the state detecting section so as to detect presence or absence of abnormality of said each of the plurality of terminals; and an electric current switching section configured to switch the direction of the electric current in a case where the abnormality detecting section has detected the abnormality.

* * * * *